US011547180B2

(12) United States Patent
Fedderly et al.

(10) Patent No.: US 11,547,180 B2
(45) Date of Patent: Jan. 10, 2023

(54) SOLE STRUCTURE WITH OVERMOLDED CLEATS

(71) Applicant: NIKE, Inc., Beaverton, OR (US)

(72) Inventors: Josh A. Fedderly, Portland, OR (US); John Hlavacs, Portland, OR (US); Jim Baucom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 31 days.

(21) Appl. No.: 17/171,572

(22) Filed: Feb. 9, 2021

(65) Prior Publication Data

US 2021/0244136 A1 Aug. 12, 2021

Related U.S. Application Data

(60) Provisional application No. 62/975,494, filed on Feb. 12, 2020.

(51) Int. Cl.

| | |
|---|---|
| ***A43C 15/16*** | (2006.01) |
| ***A43B 13/04*** | (2006.01) |
| ***A43B 13/26*** | (2006.01) |

(52) U.S. Cl.

CPC ..... *A43C 15/161* (2013.01); *A43B 13/04* (2013.01); *A43B 13/26* (2013.01); *A43C 15/165* (2013.01)

(58) Field of Classification Search

CPC ..... A43C 15/161; A43C 15/165; A43B 13/04; A43B 13/26

See application file for complete search history.

(56) References Cited

U.S. PATENT DOCUMENTS

| | | | | |
|---|---|---|---|---|
| 3,127,687 | A * | 4/1964 | Hollister | A43C 13/04 36/114 |
| 5,058,292 | A * | 10/1991 | Tanel | A43C 15/162 36/67 R |
| 5,987,784 | A * | 11/1999 | Bignell | B29D 35/122 36/134 |
| 7,428,790 | B2 * | 9/2008 | Pellerin | A43B 5/00 36/62 |
| 9,055,787 | B2 * | 6/2015 | Koch | A43B 13/26 |
| 10,130,143 | B2 * | 11/2018 | Cavaliere | A43C 15/161 |
| 2005/0097783 | A1 * | 5/2005 | Mills | A43C 15/162 36/126 |
| 2015/0040438 | A1 * | 2/2015 | Baucom | B29D 35/128 12/142 R |

* cited by examiner

*Primary Examiner* — Ted Kavanaugh
(74) *Attorney, Agent, or Firm* — Quinn IP Law

(57) ABSTRACT

A sole structure for an article of footwear includes a plate made of a polymeric material and a plurality of cleats each made of a metallic material. Each of the cleats is overmolded onto the plate. Each of the cleats includes an internal portion and an external portion coupled to the internal portion. The external portion is disposed outside the plate. The internal portion is disposed inside the plate. The internal portion includes a lattice framework. The lattice framework defines a plurality of holes. The plate partly extends through the holes of the lattice framework to secure the plurality of cleats to the plate.

19 Claims, 14 Drawing Sheets

SOLE STRUCTURE WITH OVERMOLDED CLEATS

CROSS-REFERENCE TO RELATED APPLICATION

This application claims priority, and the benefit of, U.S. Provisional Patent Application No. 62/975,494, filed on Feb. 12, 2020.

TECHNICAL FIELD

The present teachings generally relate to a sole structure for an article of footwear and, more particularly, to a footwear sole structure with overmolded cleats

BACKGROUND

This section provides background information related to the present disclosure which is not necessarily prior art.

Articles of footwear include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhancing traction with the ground surface. Another layer of the sole structure includes a midsole disposed between the outsole and the upper. The midsole provides cushioning for the foot and is at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

The metatarsophalangeal (MTP) joint of the foot is known to absorb energy as it flexes through dorsiflexion during running movements. As the foot does not move through plantarflexion until the foot is pushing off of a ground surface, the MTP joint returns little of the energy it absorbs to the running movement and, thus, is the source of an energy drain during running movements. Embedding flat and rigid plates having longitudinal stiffness within a sole structure increases the overall stiffness thereof.

BRIEF DESCRIPTION OF THE DRAWINGS

Embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
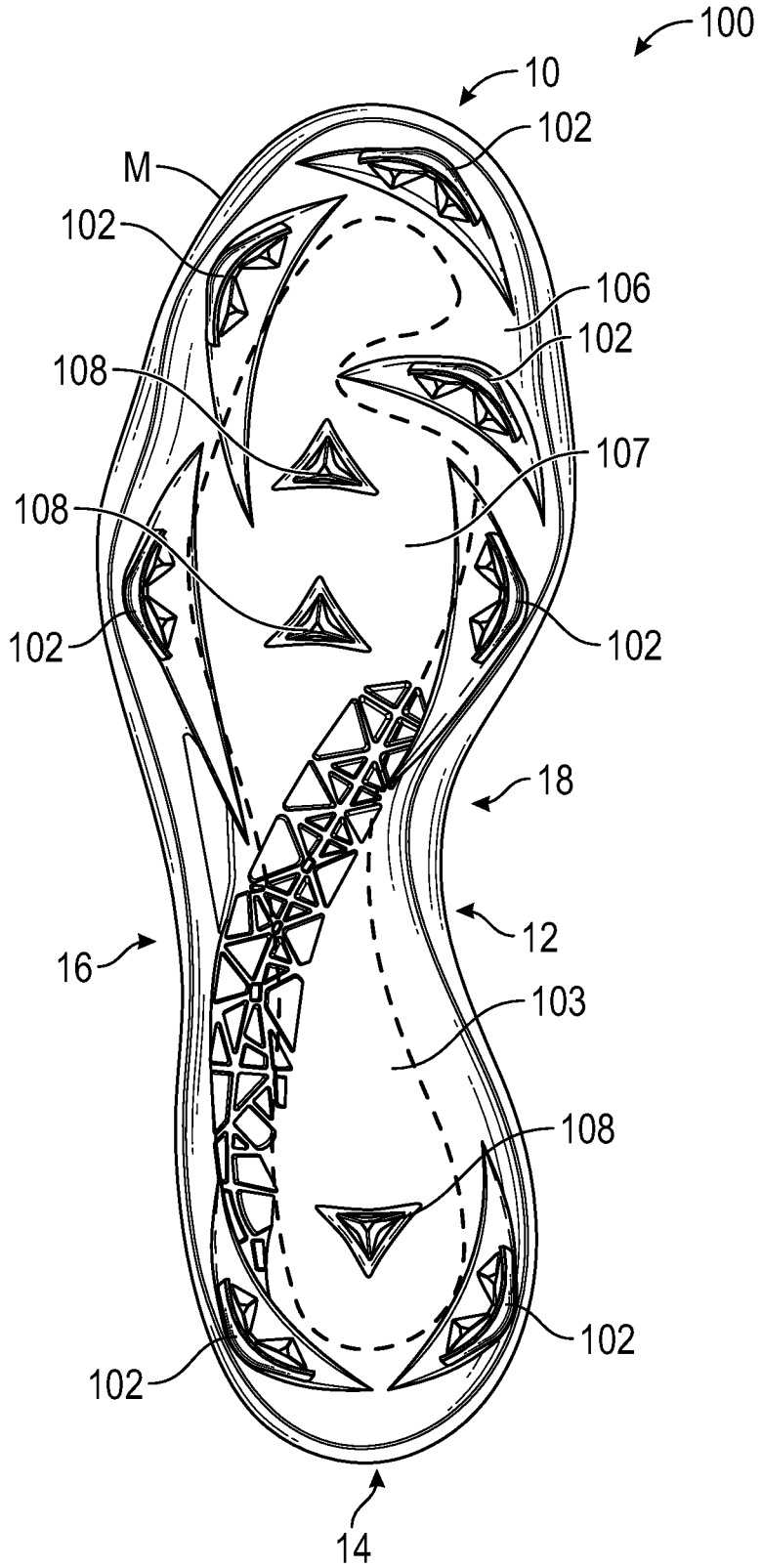
FIG. 1 is a schematic bottom view of a sole structure in accordance with an embodiment of the present disclosure.
Figure 2:
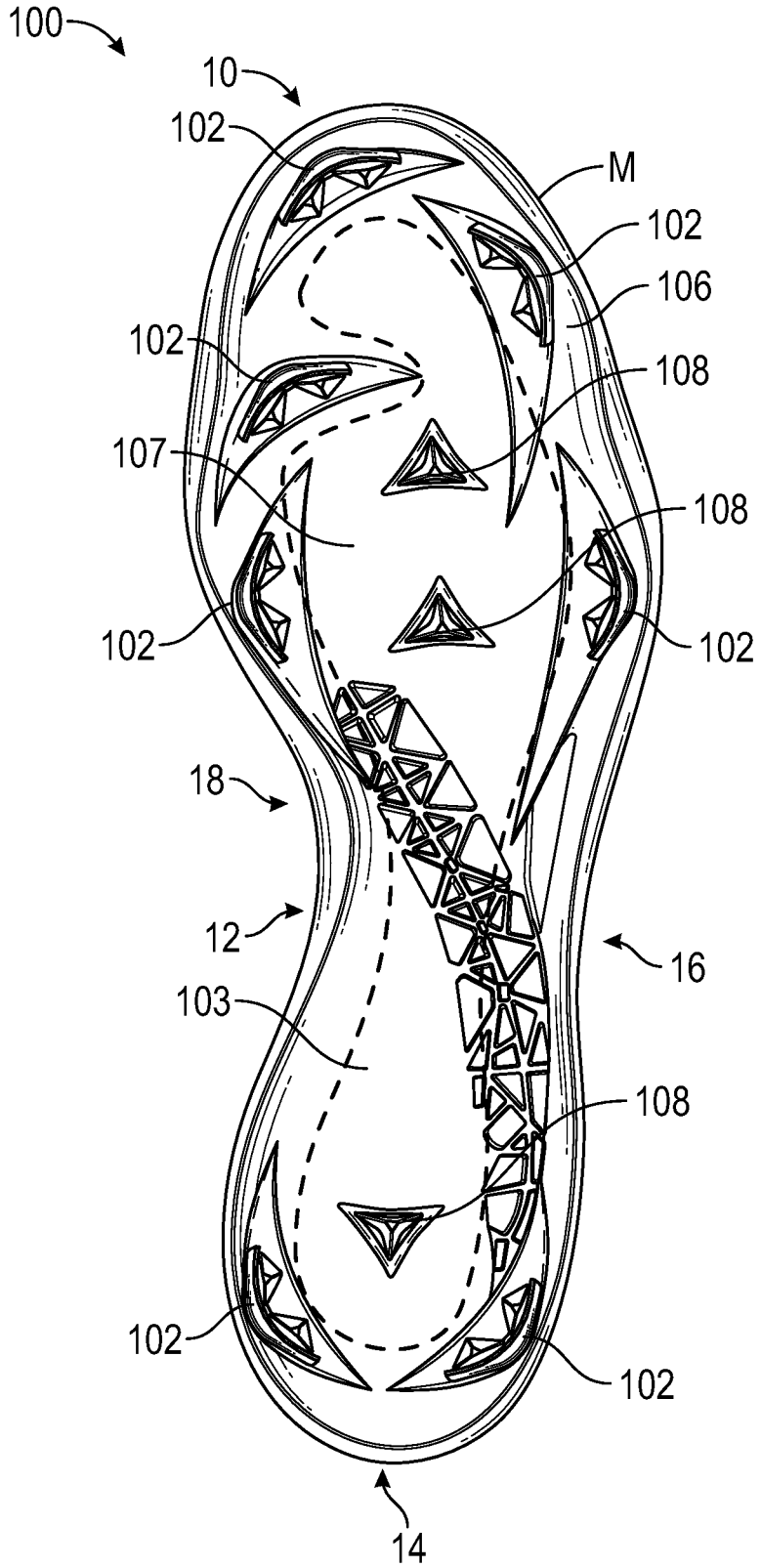
FIG. 2 is a schematic top view of the sole structure of FIG. 1.

The present disclosure describes a cleated article of footwear that may be used for outdoor sporting activities, such as baseball. In particular, the disclosed article of footwear employs one or more metal cleats/cleat tips/traction elements that are overmolded by a polymeric sole plate.

In some embodiments, the metal traction elements may be formed from a metal injection molding process that enables the creation of unique and/or specially designed internal and external geometries, which may be impractical and/or impossible to form via traditional metalworking processes. In this process, a metal powder/resin mixture is injected into a mold and solidified similar to standard injection molding. This molded part is subsequently treated to drive off the resin while fusing the remaining metal powder into a final part. Using this process, the metal cleats may each include an internal retaining geometry, such as one or more holes or ledges, that enables the overmolded polymer to mechanically lock the traction element into the plate.

Through these techniques, a sole structure may be created that retains the advantages of metal traction elements, while simultaneously permitting the creation of an engineered traction system/sole structure. Through the design, orientation, and placement of the traction elements across the sole, the present designs may enable a traction system that can, for example, resist forefoot rotation, improve push-off traction in the forefoot, improve deceleration traction in the heel, and resist unintended lateral foot translation.

The above features and advantages and other features and advantages of the present teachings are readily apparent from the following detailed description of the modes for carrying out the present teachings when taken in connection with the accompanying drawings.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of an article of footwear extends between a forefoot region and a heel region of the article of footwear. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of an article of footwear extends between a lateral side and a medial side of the article of footwear. The transverse direction or axis may also be referred to as a lateral direction or axis or a mediolateral direction or axis.

The term "vertical" refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the article of footwear is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the article of footwear in an assembled article of footwear. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

Figure 3:
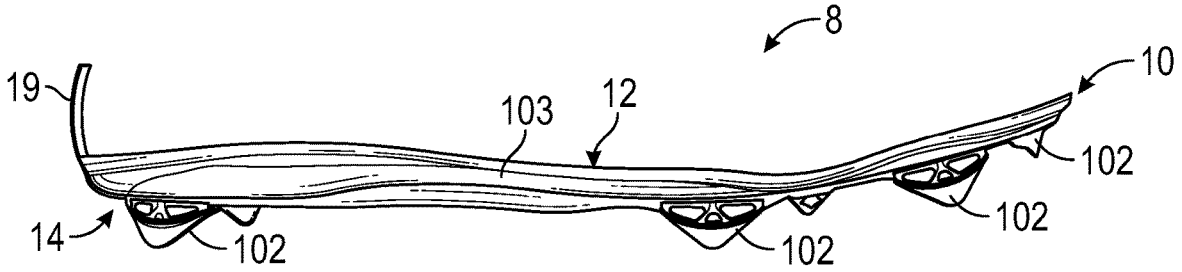
FIG. 3 is a schematic lateral view of the sole structure of FIG. 1.
Figure 4:
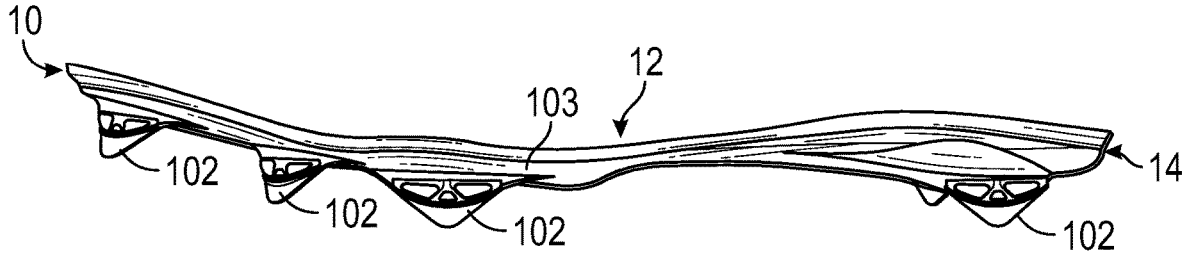
FIG. 4 is a schematic medial view of the sole structure of FIG. 1.
Figure 5:
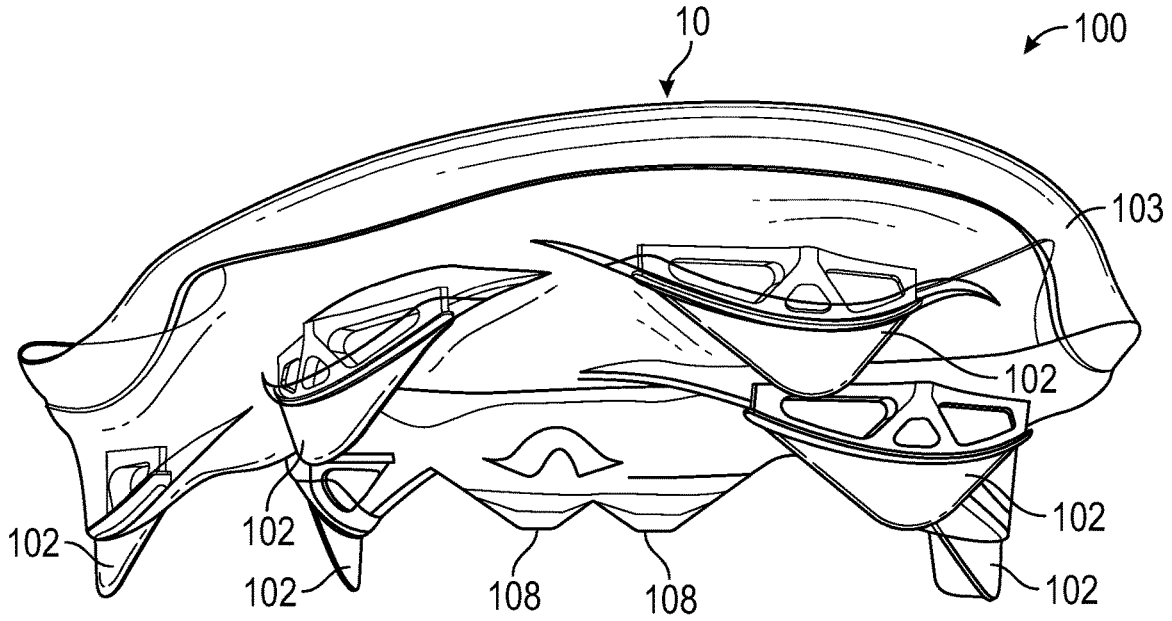
FIG. 5 is a schematic front view of the sole structure of FIG. 1.
Figure 6:
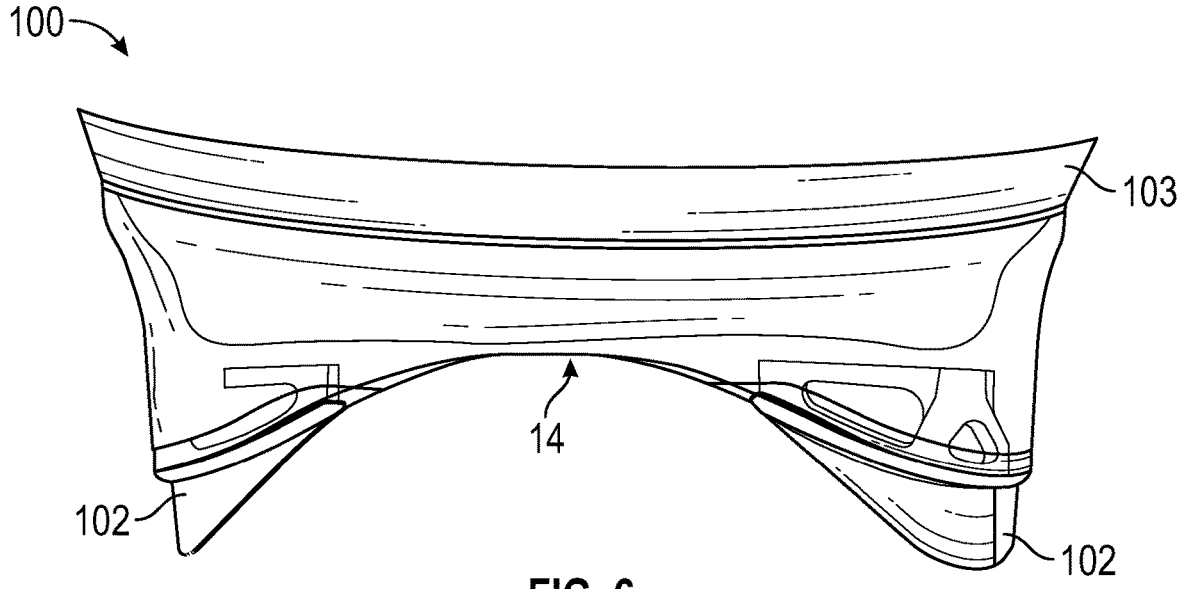
FIG. 6 is a schematic rear view of the sole structure of FIG. 1.

With reference to FIGS. 1-6, a sole structure 100 may be coupled to an upper 19 (FIG. 3) to form an article of footwear 8 (FIG. 3). The sole structure 100 may generally comprise any portion of a sole for an article of footwear. For example, the sole structure 100 could comprise an outsole for an article that is configured to come into contact with a ground surface. In cases where sole structure 100 comprises an outsole, the sole structure 100 could be attached to any other component of a sole structure (such as a midsole or insole). In other cases, sole structure 100 could be attached directly to an upper of an article of footwear. Additionally, in other embodiments, different configurations of the sole structure 100 may be included in an article of footwear.

For purposes of reference, components of the sole structure 100 may be divided into a forefoot portion 10, a midfoot portion 12, and a heel portion 14. The forefoot portion 10 may be generally associated with the toes and joints connecting the metatarsals with the phalanges. The midfoot portion 12 may be generally associated with the arch of a foot. The heel portion 14 may be generally associated with the heel of a foot, including the calcaneus bone. In addition, the sole structure 100 may include a lateral side 16 and a medial side 18. In particular, the lateral side 16 and the medial side 18 may be opposing sides of sole structure 100. Furthermore, both the lateral side 16 and the medial side 18 may extend through the forefoot portion 10, the midfoot portion 12 and the heel portion 14.

It will be understood that the forefoot portion 10, the midfoot portion 12 and the heel portion 14 are only intended for purposes of description and are not intended to demarcate precise regions of sole structure 100. The lateral side 16 and the medial side 18 are intended to represent generally two sides of a sole structure, rather than precisely demarcating the sole structure 100 into two halves. In addition, the forefoot portion 10, the midfoot portion 12, and the heel portion 14, as well as the lateral side 16 and the medial side 18, can also be applied to individual components of a sole structure, such as a sockliner, insole or any other component.

In some embodiments, the sole structure 100 may include plate 103. In some cases, plate 103 may be a full-length plate, including a forefoot portion, a midfoot portion and a heel portion. In other cases, however, plate 103 may be a partial length plate. For example, in some cases, the plate 103 may only extend through the forefoot of an article of footwear 8. The plate 103 includes a peripheral portion 106 extending along a periphery of the sole structure 100. Further, the plate 103 includes a central portion 107 entirely surrounded by the peripheral portion 106 of the plate 103. Stated differently, the peripheral portion 106 continuously surrounds the central portion 107. As such, the entire central portion 107 is surrounded by the peripheral portion 106. A demarcation line M is shown in dashed lines and divides the peripheral portion 106 from the central portion 107 of the plate 103.

In some embodiments, the sole structure 100 includes a plurality of first cleats 102 disposed along (and attached to) the peripheral portion 106 of the plate 103. The first cleats 102 are configured to penetrate the ground to enhance the traction of the sole structure 100. All the first cleats 102 are entirely disposed in the peripheral portion 106 of the plate 103 to enhance traction. The first cleats 102 are wholly or partly made of a metallic material, thereby allowing a wear to penetrate the ground to improve traction. Because the first cleats 102 are made of a metallic material and are disposed in the peripheral portion 106 of the plate 103, the sole structure 100 allows the user to easily change directions without slipping.

In some embodiments, the sole structure 100 includes seven of the first cleats 102. Two of the first cleats 102 are disposed in the heel portion 14 of the sole structure 100 to help the footwear wearer make sudden stops without slipping. In particular, the one of the first cleats 102 may be disposed on the lateral side 16 of the heel portion 14, and another first cleat 102 may be disposed on the medial side 18 of the heel portion 14. Five of the first cleats 102 are disposed in the forefoot portion 10 of the sole structure 100 to help the footwear wearer start running in a sudden fashion without slipping. In some embodiments, none of the first cleats 102 is located in the midfoot portion 12 to minimize weight. While the depicted embodiment shows seven first cleats 102, it is contemplated that the sole structure 100 may include more or fewer first cleats 102.

The sole structure 100 further includes a plurality of second cleats 108 disposed along (and attached to) the central portion 107 of the plate 103. The second cleats 108 are configured to penetrate the ground to enhance the traction of the sole structure 100. All the second cleats 108 are entirely disposed in the central portion 107 of the plate 103 to enhance traction. The second cleats 108 are wholly or partly made of a metallic material, thereby allowing a wearer to penetrate the ground to improve traction. Because the second cleats 108 are made of a metallic material and are disposed in the central portion 107 of the plate 103, the sole structure 100 allows the user to remain stationary without slipping.

In some embodiments, the sole structure 100 includes three of the second cleats 108. Two of the second cleats 108 are disposed in the forefoot portion 10 of the sole structure 100 to enhance traction during dorsiflexion. A single one of the second cleats 108 is disposed in the heel portion 14 of the sole structure 100 to enhance traction during plantar flexion. In some embodiments, none of the second cleats 108 is located in the midfoot portion 12 to minimize weight. While the depicted embodiment shows three second cleats 108, it is contemplated that the sole structure 100 may include more or fewer second cleats 108.

Figure 7:
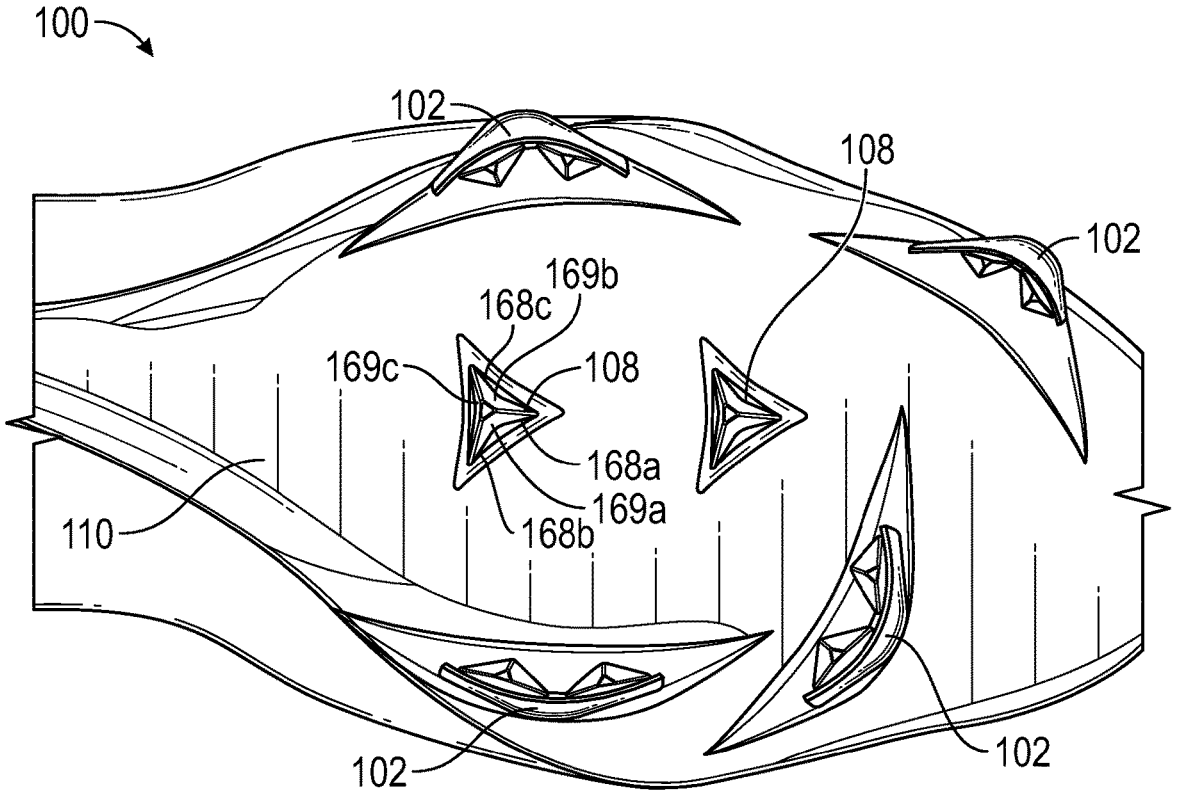
FIG. 7 is a schematic bottom view of a forefoot portion of the sole structure of FIG. 1, without the external shell.
Figure 11:
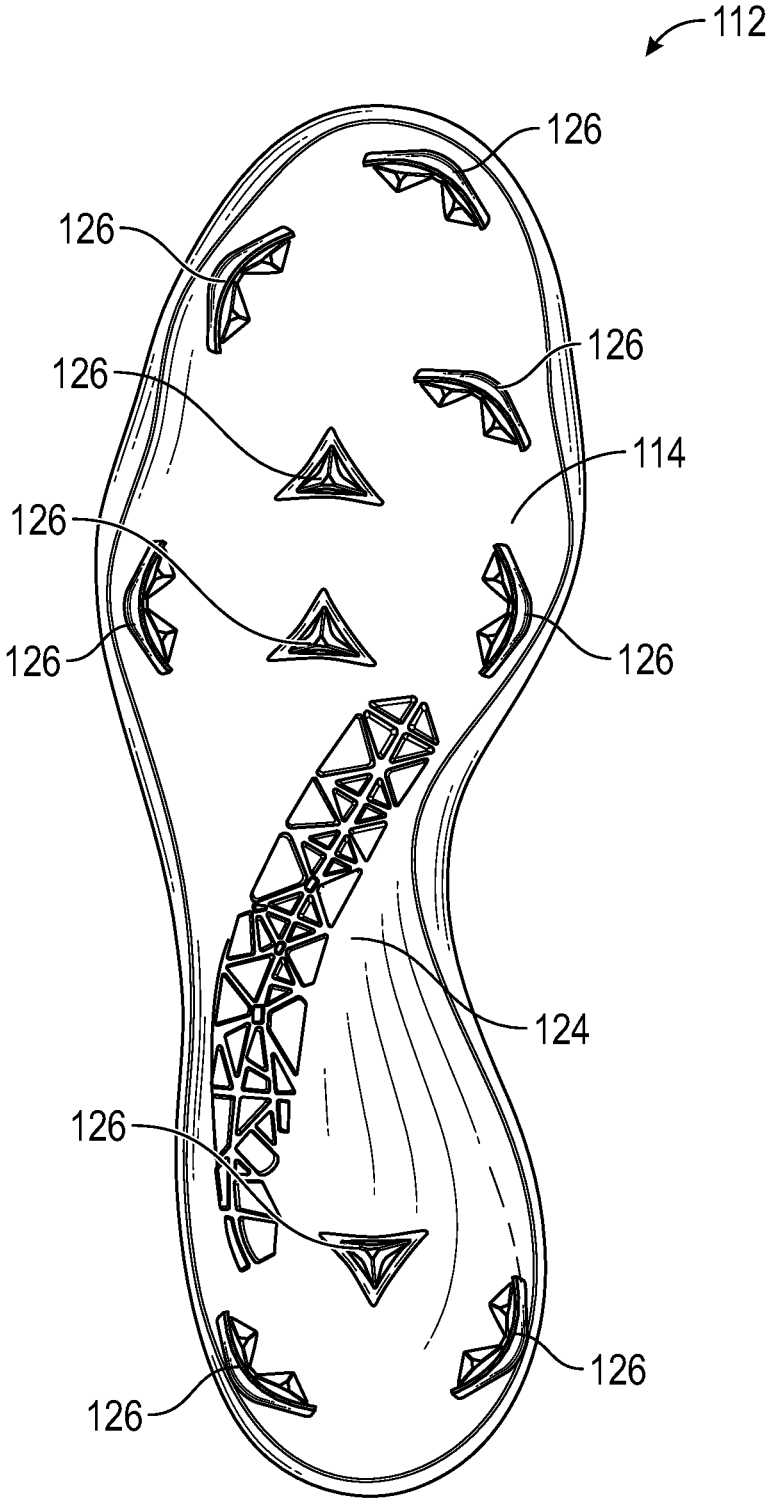
FIG. 11 is a schematic bottom view of an external shell of the sole structure of FIG. 1.
Figure 12:
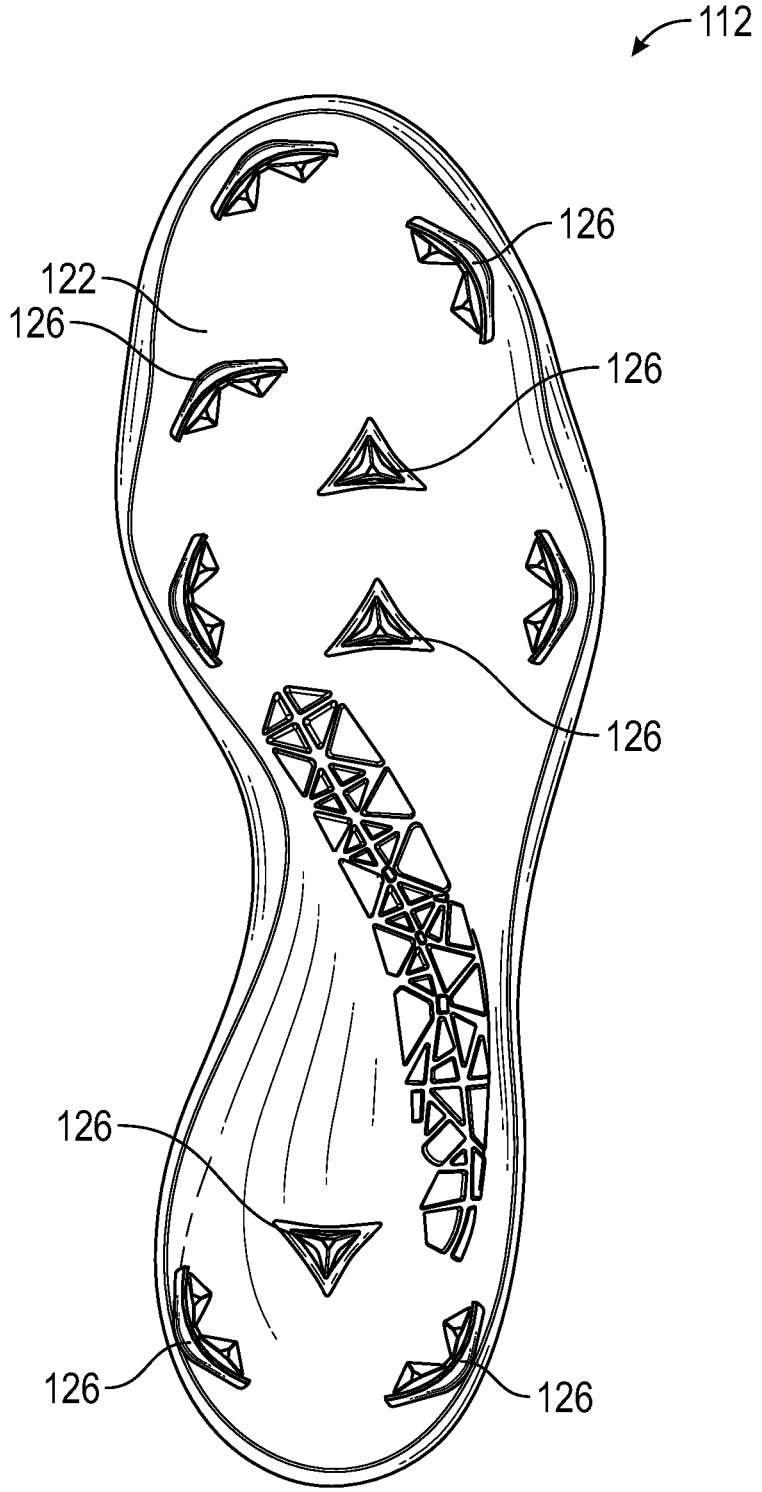
FIG. 12 is a schematic top view of the external shell of FIG. 12.

With reference to FIG. 7, the plate 103 includes an internal structure 110 and an external shell 112 (FIG. 12). The internal structure 110 is disposed over and (secured to) the external shell 112. The internal structure 110 and the external shell 112 may be wholly or partly made of different materials. The external shell 112 may be overmolded to the external shell 112. The external shell 112 may serve as an outsole of the sole structure 100 and has a ground-engaging surface 114 (FIG. 11) configured to engage the ground. Further, the internal structure 110 may be overmolded to the first cleats 102 and the second cleats 108. As specifically shown in FIG. 8, due to the overmolding, the parts of the first cleats 102 and the second cleats 108 are embedded in the internal structure 110 to strengthen the connection between the internal structure 110 and first cleats 102 and the second cleats 108 in multiple directions.

Figure 8:
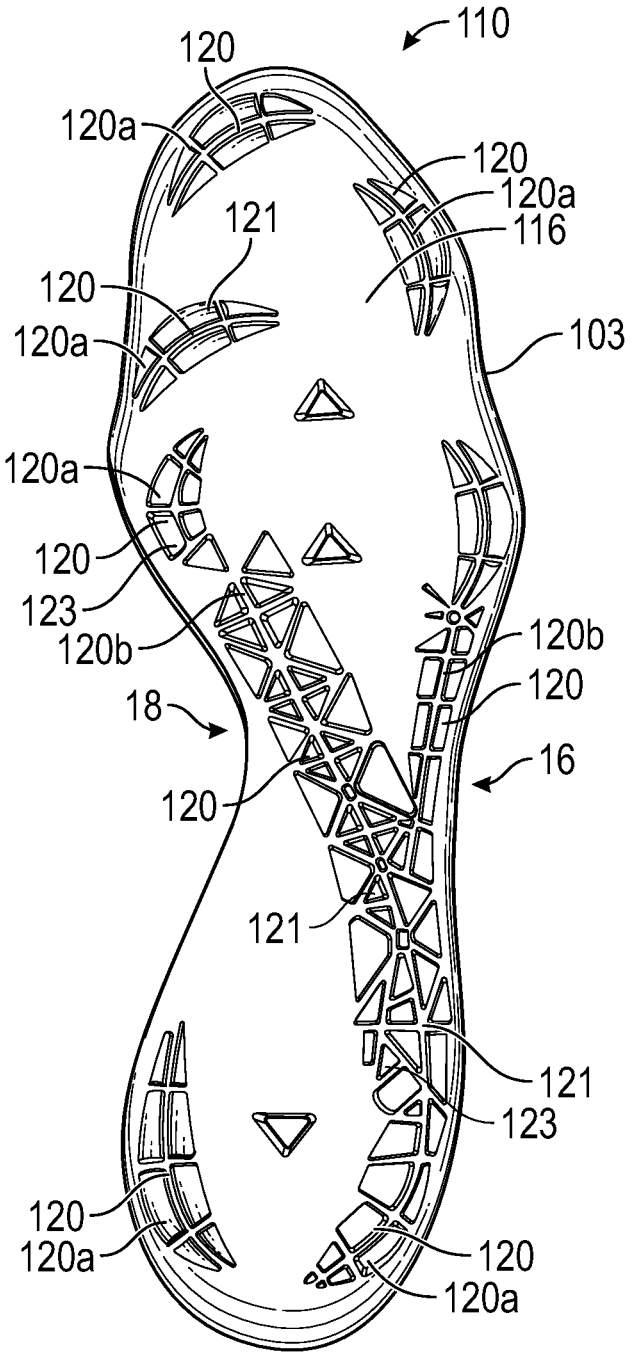
FIG. 8 is a schematic top view of an internal structure of the plate of the sole structure of FIG. 1.
Figure 9:
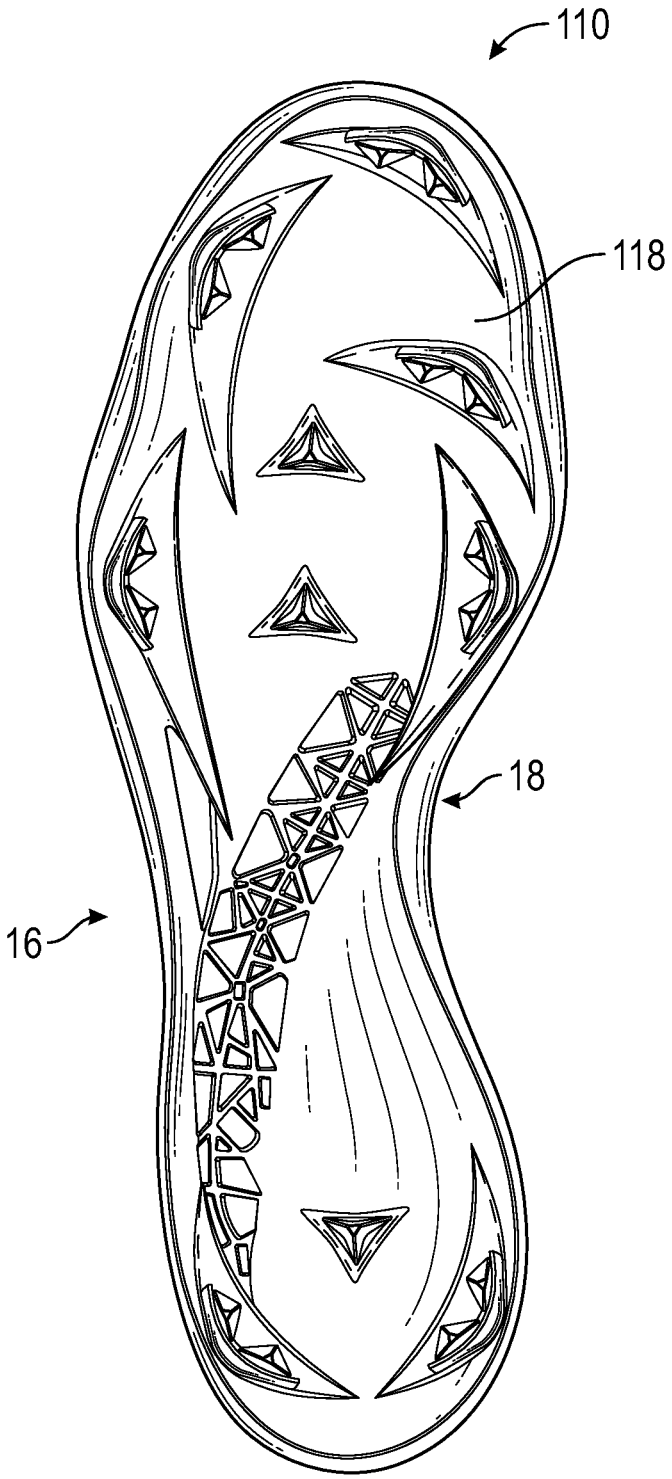
FIG. 9 is a schematic bottom view of the internal structure of FIG. 9.
Figure 10:
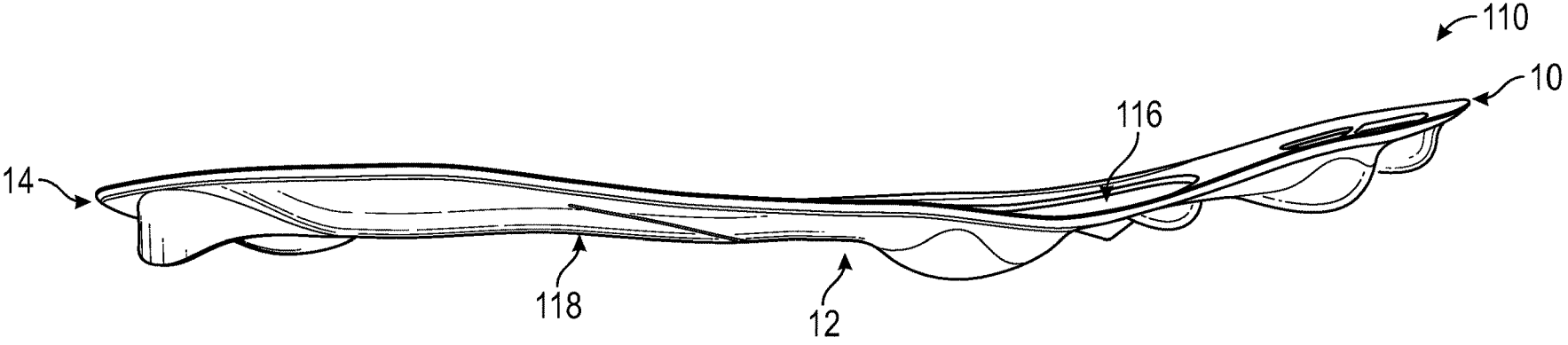
FIG. 10 is a schematic side view of the internal structure of FIG. 9.

With reference to FIGS. 8-10, the internal structure 110 of the plate 103 is wholly or partly made of a polymeric material. The internal structure 110 includes an inner structure surface 116 and an outer structure surface 118 opposite the inner structure surface 116. The internal structure 110 may include separate and discrete supporting structures 120 disposed in a different location of the inner structure surface 116. Some of the supporting structures 120 are aligned with the first cleats 102, and these supporting structures 120 are referred to as the cleat supporting structures 120*a*. The cleat supporting structures 120*a* have the same shape as the first cleats 102 to support the entirety of each of the first cleats 102. Further, the cleat supporting structures 120*a* are aligned with the first cleats 102 to properly support each of the first cleats 102. In the depicted embodiment, no supporting structure 120 is aligned with the second cleats 108 to facilitate the manufacturing process of the sole structure 100. Some of the supporting structures 120 are not aligned with cleats (i.e., the first cleats 102 or the second cleats 108) and these supporting structures 120 are referred to as stand-alone supporting structures 120*b*. In the depicted embodiment, one stand-alone supporting structure 120*b* is oriented diagonally along the central portion 107 of the plate 103 and the midfoot portion 12 of the plate 103, and another stand-alone supporting structure 120*b* is disposed along the peripheral portion 106 of the plate 103. Specifically, one of the stand-alone supporting structures 120*b* is disposed at the lateral side 16 of the sole structure 100.

In different embodiments, the supporting structures 120 may have a lattice geometry. As used herein, the term "lattice geometry" means a geometry that has crisscrossed pattern of strips 121 and recesses 123 or voids between the crossed strips 121. It is envisioned that the supporting structures 120 may have a square, rectangular lattice-like cross-sectional geometry, a hexagonal lattice-like, or honeycomb shaped, cross-sectional geometry. The cross-sectional geometry could be associated with any other shapes including triangles, rectangles, circles, ellipses, polygons, regular shapes as well as irregular shapes. Moreover, the pattern associated with supporting structure 120 could be the same throughout the sole structure 100 or may vary over different regions.

Figure 13:
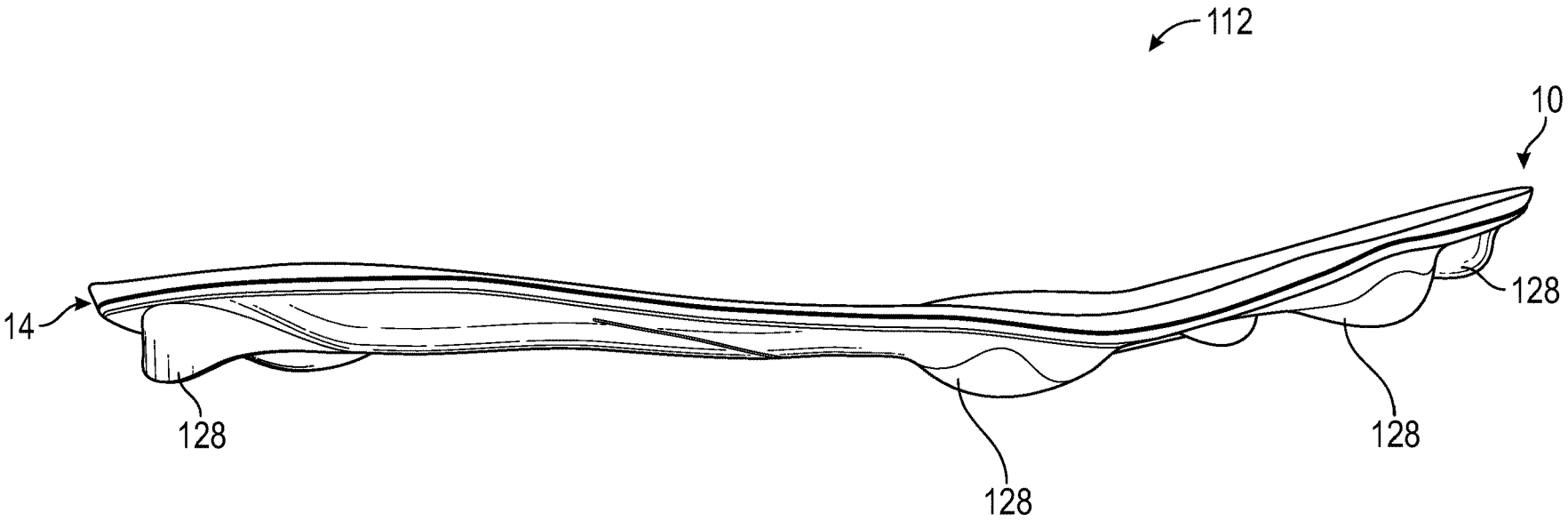
FIG. 13 is a schematic side view of the external shell of FIG. 12.
Figure 14:
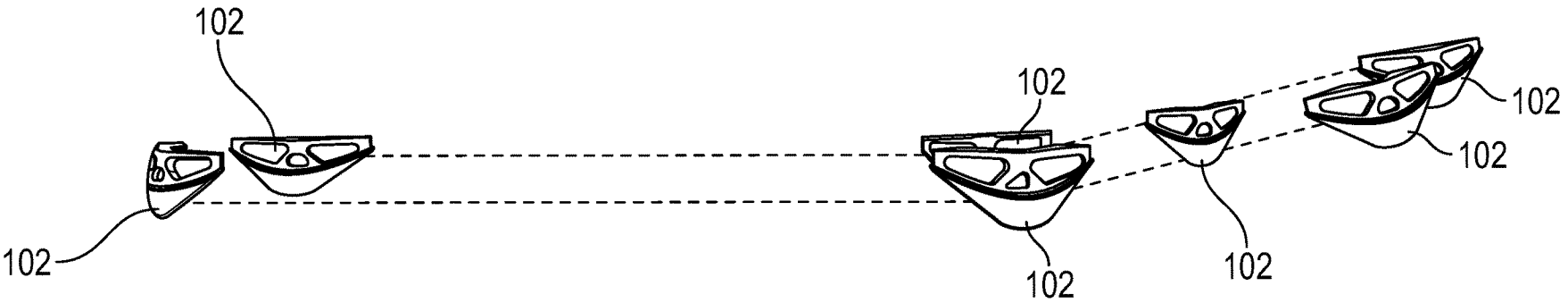
FIG. 14 is a schematic side view of a plurality of first cleats of the sole structure of FIG. 1, without depicting the plate.
Figure 15:
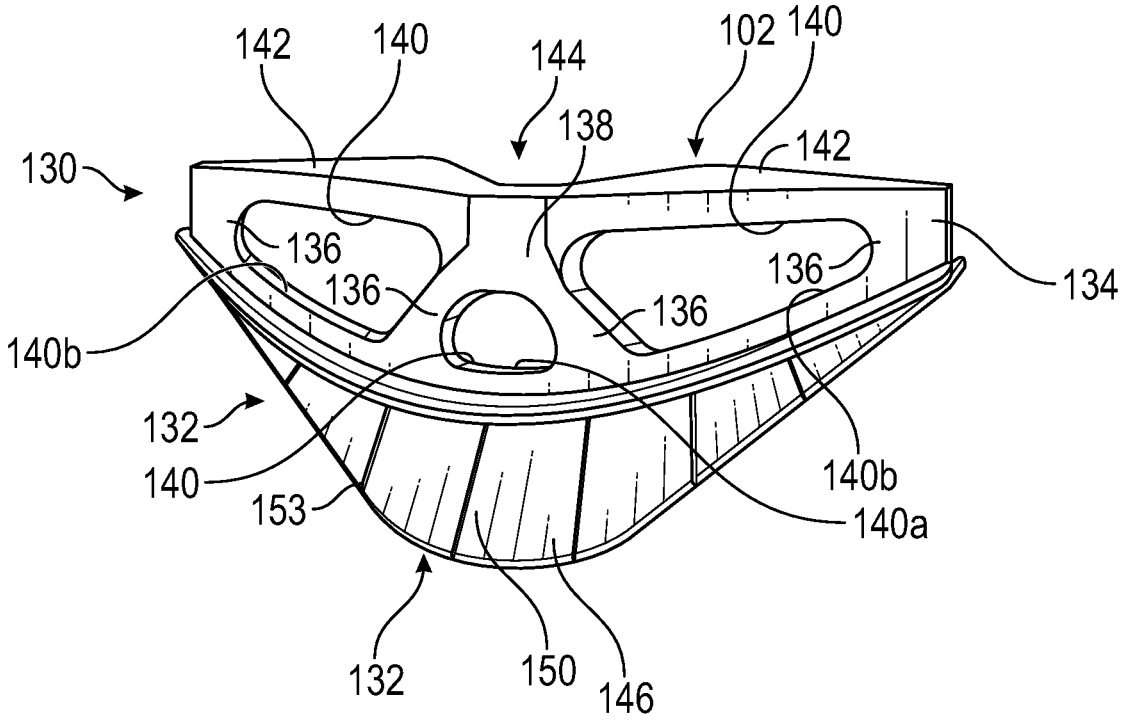
FIG. 15 is a schematic isometric, front view of a first cleat of the sole structure of FIG. 15.
Figure 16:
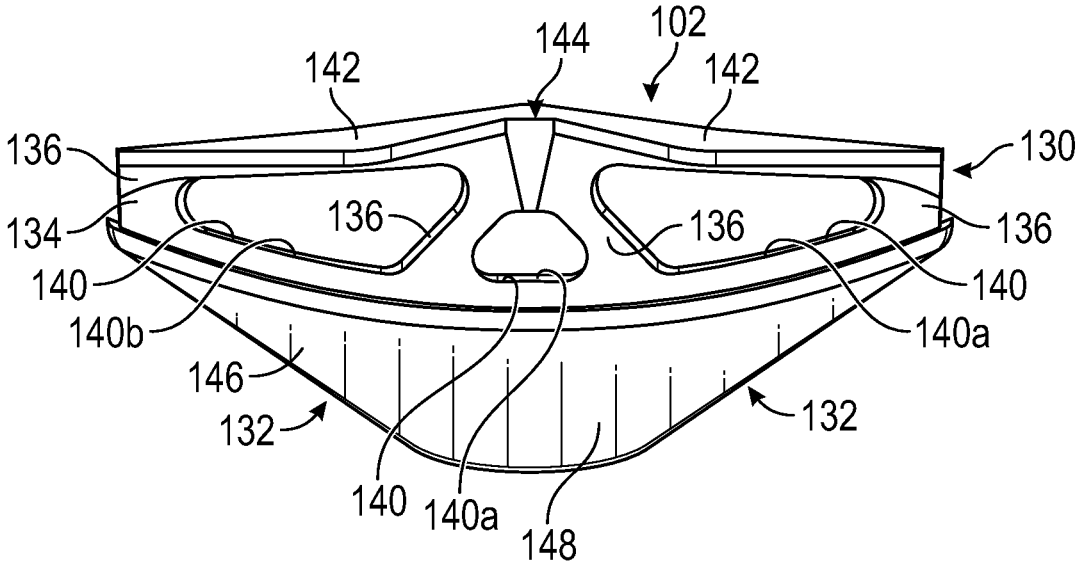
FIG. 16 is a schematic isometric, rear view of the first cleat of FIG. 16.
Figure 17:
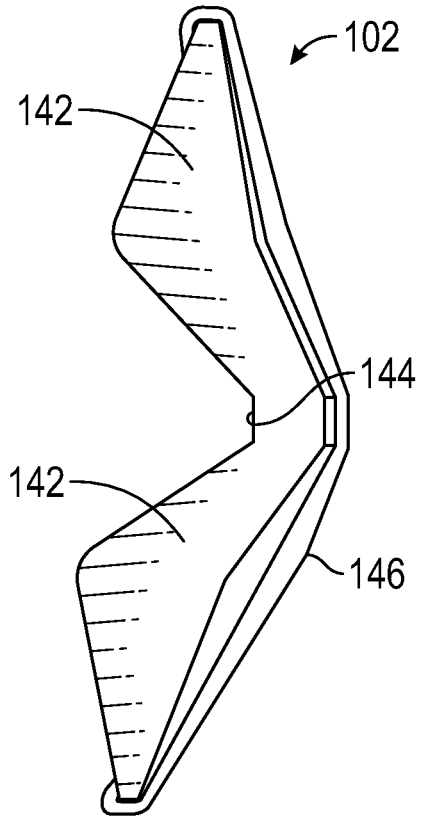
FIG. 17 is a schematic top view of the first cleat of FIG. 16.
Figure 18:
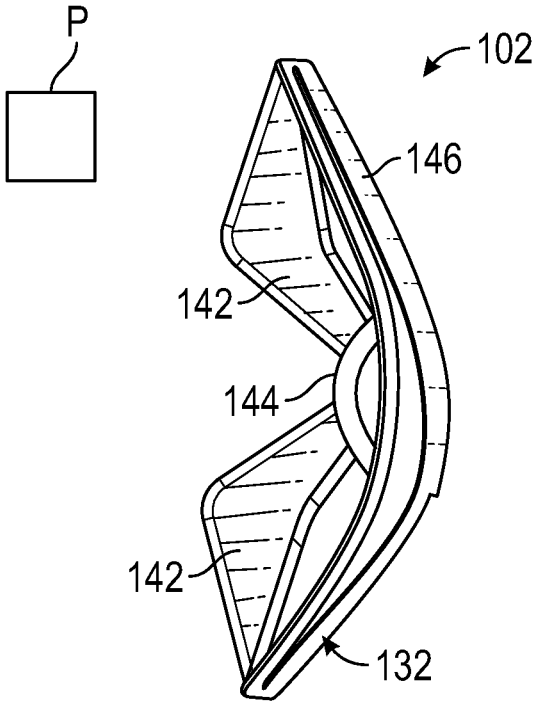
FIG. 18 is a schematic bottom view of the first cleat of FIG. 16.
Figure 19:
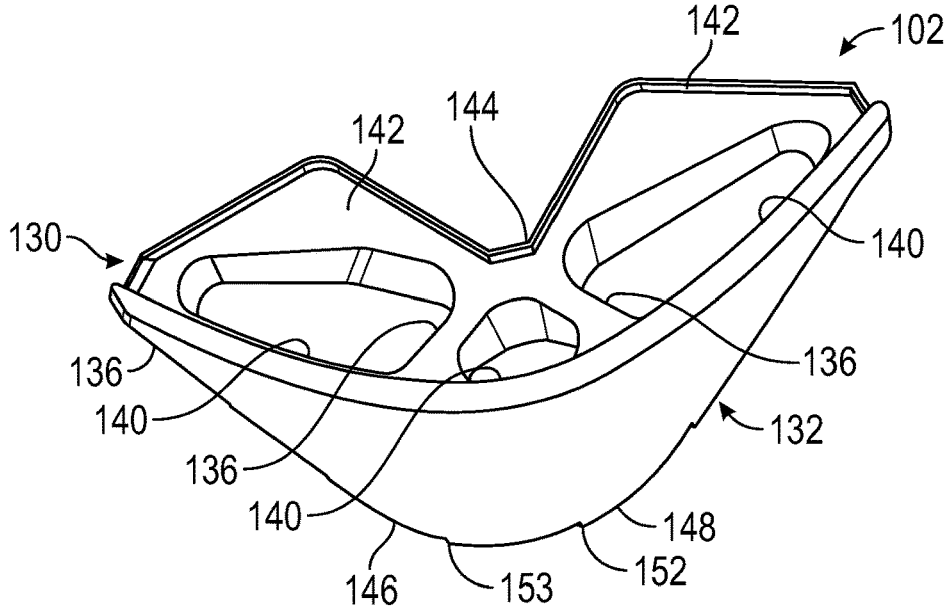
FIG. 19 is a schematic isometric, rear, bottom view of the first cleat of FIG. 16.
Figure 20:
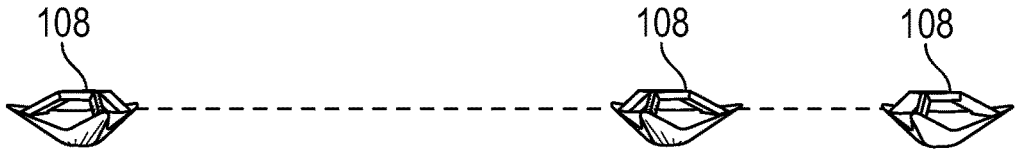
FIG. 20 is a schematic side of a plurality of second cleats of the sole structure of FIG. 1, without depicting the plate.
Figure 21:
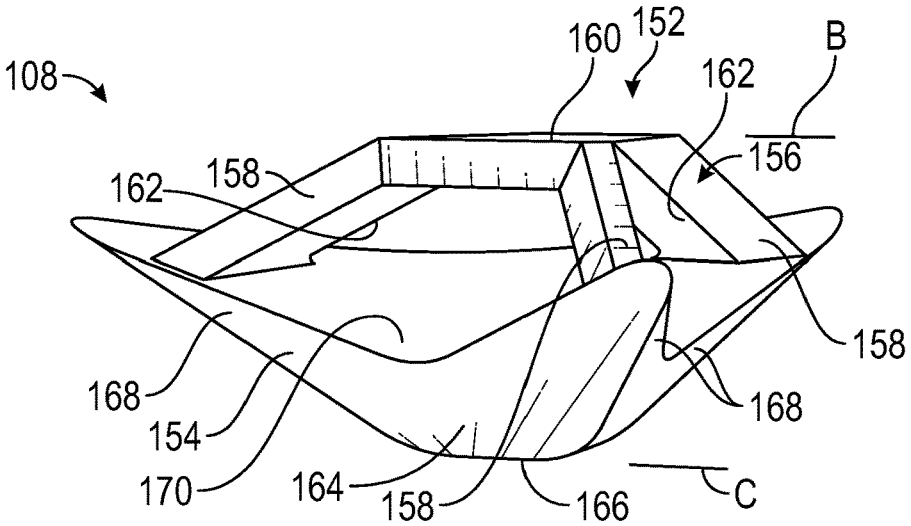
FIG. 21 is a schematic front view of one of the second cleats of FIG. 21.
Figure 22:
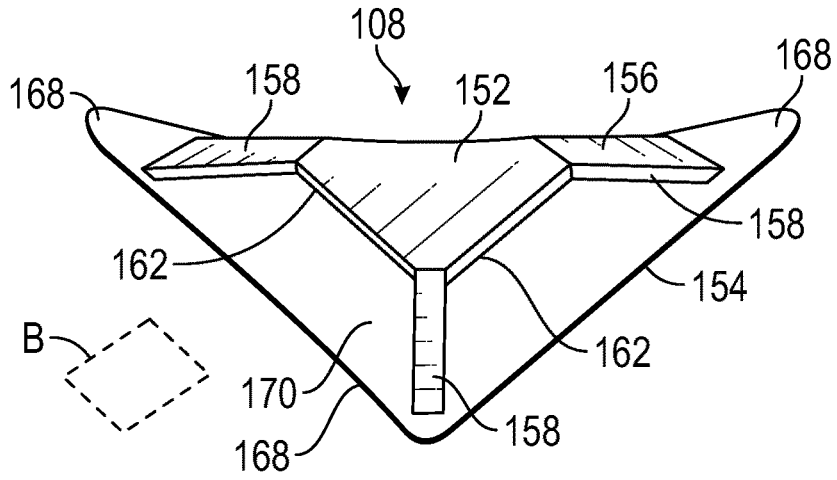
FIG. 22 is a schematic isometric top view of the second cleat of FIG. 22.
Figure 23:
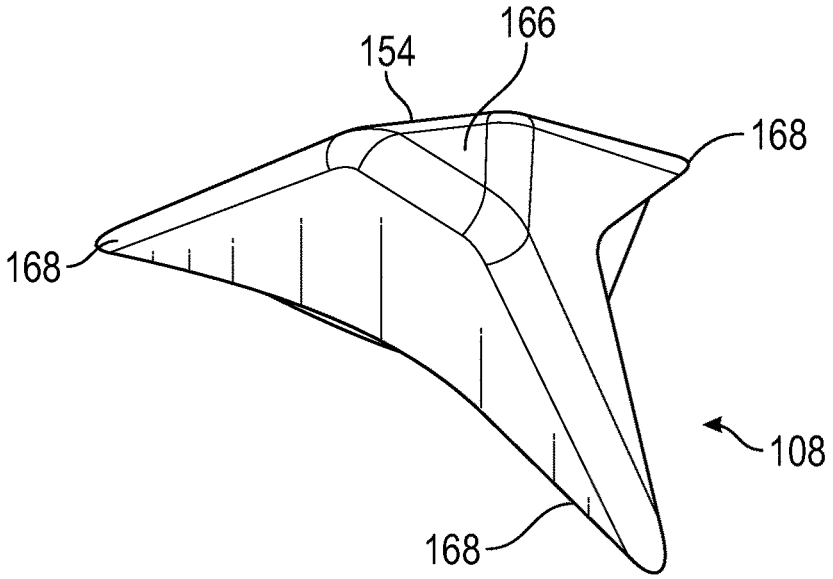
FIG. 23 is a schematic isometric bottom view of the second cleat of FIG. 21.

With reference to FIGS. 11-13, the external shell 112 may be wholly or partly made of a polymeric material. As discussed above, the external shell 112 may serve as an outsole. Further, the internal structure 110 is made of a material (e.g., nylon copolymer) that is stiffer than the material forming the external shell 112. The material forming the internal structure 110 should be stiffer than the material forming the external shell 112 in order to prevent the first cleats 102 and 108 from detaching from the plate 103. Additionally, the external shell 112 is thinner than the internal structure 110 to minimize weight. The external shell 112 may also be overmolded over the internal structure 110 to secure the external shell 112 to the internal structure 110. The external shell 112 has an inner shell surface 122 and an outer shell surface 124 opposite the inner shell surface 122. The inner shell surface 122 may be contoured to follow the shape of the outer structure surface 118 of the internal structure 110 (FIG. 8). The external shell 112 includes a plurality of thru-holes 126 each extending through the inner shell surface 122 and the outer shell surface 124. Each thru-hole 126 is configured, sized, and shaped to receive either one of the first cleat 102 or one of the second cleats 108. As a result, the first cleats 102 and the second cleats 108 extend outside the sole structure 100 through the thru-holes 126. The shape of some of the thru-holes 126 resemble the shape of the first cleats 102, while the shape of other thru-holes 126 resemble the shape of the second cleats 108. As shown in FIG. 13, the external shell 112 may include protruding shell portions 128 to help secure the first cleats 102 and the second cleats 108 to the external shell 112. The first cleats 102 have different orientations relative to the plate 103 to facilitate braking and running.

With reference to FIGS. 14-19, the plurality of first cleats 102 are spaced apart from each other along the plate 103 and are connected to each other only through the plate 103 (FIG. 1). Each first cleat 102 is wholly or partly made of a metallic material and may be made using metal injection molding, thereby facilitating the manufacture of complexly shaped first cleats 102. Each first cleat 102 includes a first internal portion 130 and a first external portion 132. The first internal portion 130 is configured to be disposed inside the plate 103, whereas the first external portion 132 is configured to be disposed outside the plate 103.

The first internal portion 130 may be entirely embedded inside the internal structure 110 to secure the first cleat 102 to the plate 103. Further, the first internal portion 130 includes a first lattice framework 134. In the depicted embodiment, the first lattice framework 134 is configured as a truss to create a rigid structure. The first lattice framework 134 includes a plurality of struts 136. Some of the struts 136 are interconnected to each other at a central lattice structure 138 to define a plurality of first holes 140. In the depicted embodiment, two of the struts 136 are joined to each other at the central lattice structure 138 to define a central hole 140*a* of the plurality of first holes 140. The first lattice framework 134 also defines two lateral holes 140*b*. The central hole 140*a* is disposed between the lateral holes 140*b*. Further, the central hole 140*a* is disposed between the two lateral holes 140*b*. Portions of the plate 103 (e.g., portions of the internal structure 110) extend through the first holes 140 to secure the first cleats 102 to the plate 103. The struts 136 may have different angular orientations to allow the first lattice framework 134 to resist forces on the first cleat 102 along different directions.

The first internal portion 130 of the first cleat 102 further includes a plurality of protruding panels 142 extending orthogonally from the first lattice framework 134. In the depicted embodiment, the first internal portion 130 includes two protruding panels 142 that are spaced apart from each other. Accordingly, an opening 144 is defined between the two protruding panels 142. Portions of the plate103 (e.g., portions of the internal structure 110) extend through the opening 144 to secure the first cleat 102 to the plate 103. Each of the protruding panels 142 has a planar configuration that extends along virtual plane P. Each of the protruding panels 142 may have a triangular shape to maximize the resistance to forces exerted on the first cleat 102. Some of the struts 136 may be obliquely angled relative to each of the protruding panels 142 resist forces on the first cleat 102 along different directions. The protruding panels 142 are oriented substantially perpendicular to the first external portion 132 (and/or substantially parallel to an outer surface of the plate 103) to prevent the first cleats 102 from detaching from the plate 103 when the footwear wearer makes sudden and forceful movements.

The first external portion 132 of the first cleat 102 is disposed outside of the plate 103 to engage the ground and includes a curved plate 146. For instance, the curved plate 146 may have a boomerang-like shape. Because the first cleat 102 is produced via metal injection molding, the first external portion 132 and the first internal portion 130 are integrally coupled to each other to form a one-piece structure, thereby enhancing the structural integrity of the first cleat 102. The curved plate 146 has an inner plate surface 148 and an outer plate surface 150 opposite the inner plate surface 148. The curved plate 146 may have a serrated configuration on the inner plate surface 148, the outer plate surface 150, or both to maximize the grip of the first cleats 102 on the ground. Accordingly, the curved plate 146 include teeth 153 forming the serrated configuration on the outer plate surface 150. In the depicted embodiment, the teeth 153 are disposed on the outer plate surface 150.

With reference to FIGS. 20-23, the plurality of second cleats 108 are spaced apart from each other along the plate 103 and are connected to each only through the plate 103. Each second cleat 108 is wholly or partly made of a metallic material and may be made using metal injection molding, thereby facilitating the manufacture of complexly shaped second cleats 108. Each second cleat 108 includes a second internal portion 152 and a second external portion 154. The second internal portion 152 is configured to be disposed inside the plate 103, whereas the second external portion 154 is configured to be disposed outside the plate 103.

The second internal portion 152 may be entirely embedded inside the internal structure 110 to secure the second cleat 108 to the plate 103 (FIG. 1). Further, the second internal portion 152 includes a second lattice framework 156. In the depicted embodiment, the second lattice framework 156 is configured as a truss to create a rigid structure. The second lattice framework 156 includes a plurality of bars 158. The bars 158 are coupled to each other through an upper panel 160. The upper panel 160 has a planar configuration that extends along virtual plane B. Further, each of the bars 158 is directly connected to the upper panel 160 at an obliquely angle relative to the virtual plane B, thereby allowing the second cleat 108 to resist forces in different directions. The bars 158 are also directly connected to the second external portion 154 to define a plurality of cleat openings 162 between the upper panel 160 and the second external portion 154. In the depicted embodiment, the second internal portion 152 includes only three bars 158. However, it is contemplated that the second internal portion 152 may include more or fewer cleat openings 162. Regardless of the number of cleat openings 162, portions of the plate 103 (e.g., portions of the internal structure 110) extend through the cleat openings 162 to secure the second cleats 108 to the plate 103. The bars 158 may have different angular orientations to allow the second lattice framework 156 to resist forces on the second cleat 108 along different directions.

The second external portion 154 of the second cleat 108 is disposed outside of the plate 103 to engage the ground and includes a pronged structure 164. For instance, the pronged structure 164 may have a tri-star shape and includes a base 166. The base 166 has a planar configuration that extends along a virtual plane C. The virtual plane C is parallel to the virtual plane B to facilitate manufacturing of the second cleat 108. The pronged structure 164 may include three prongs 168 directly connected to the base 166. However, it is envisioned that the pronged structure 164 may include more or fewer prongs 168. Irrespective of the number of prongs 168, the prongs 168 are spaced apart from each other at an oblique angle relative to each other. Further, each of the prongs 168 is angled upwardly toward the upper panel 160. Therefore, each of the prongs 168 is oriented at an oblique angle relative to the base 166 and the upper panel 160. The pronged structure 164 further defines a recessed surface 170 opposite the base 166. The recessed surface 170 partly defines the cleat openings 162, thereby allowing portions of the plate 103 (i.e., the internal structure 110) to extend through the second cleat 108. Consequently, the second cleats 108 are secured to the plate 103.

Returning to FIG. 7, each of the second cleats 108 has a first prong 168*a*, a second prong 168*b*, and a third prong 168*c*. The second cleat 108 also includes a first curved wall 169*a* between the first prong 168*a* and the second prong 168*b*, a second curved wall 169*b* between the first prong 168*a* and the third prong 168*c*, and a third curved wall 169*c* between the second prong 168*b* and the third prong 168*c*. The curvature of the third curved wall 169*c* is less than the curvature of the first curved wall 169*a* and the second curved wall 169*b* to facilitate braking. The second cleats 108 may have different orientations to facilitate breaking and engagement with the ground.

Figure 24:
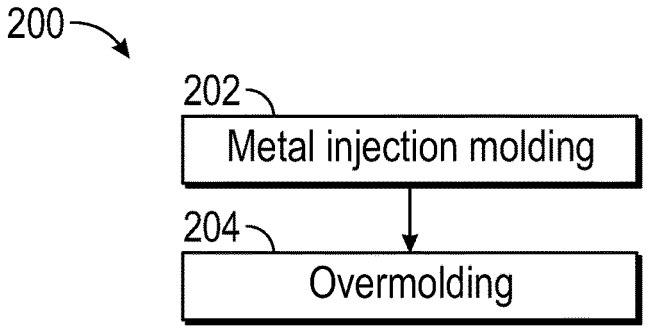
FIG. 24 is a flowchart of a method of making the sole structure of FIG. 1.

FIG. 24 is a flowchart of a method 200 of making the sole structure 100. The method 200 begins at block 202. At block 202, the first cleat 102 and the second cleat 108 are formed using metal injection molding. It is desirable to use metal injection molding to facilitate manufacturing complexly shaped metallic cleats, such as the first cleat 102 and the second cleat 108. The metal injection molding may include injecting a mixture of metallic powder and a polymeric material into a mold to form a preform. The, the preform is removed from the mold. Next, the preform undergoes a sintering process to remove the polymeric material from the preform, thereby forming the final part. The sintering process includes heating the preform in a vacuum. Once the first cleats 102 and the second cleats 108 are formed, the method 200 proceeds to block 204.

At block 204, the plate 103 is overmolded onto the first cleat 102 and the second cleats 108 to form the sole structure 100. It is desirable to use overmolding to secure parts made of different materials together. In this case, the plate 103 is made of a polymeric material, and the first cleat 102 and the second cleat 108 are made of a metallic material. Thus, by using overmolding, the plate 103 may be secured to the first cleats 102 and the second cleats 108. In some embodiments, the internal structure 110 may be initially overmolded over the first cleats 102 and the second cleats 108 to connect the internal structure 110 to the first cleats 102 and the second cleats 108. Then, the external shell 112 may be overmolded over the internal structure 110 to connect the internal structure 110, the first cleats 102, the second cleats 108, and the external shell 112 together. Accordingly, block 202 may be a two-step injection molding process.

Clause 1: A sole structure for an article of footwear includes a plate comprising a polymeric material and a plurality of cleats each comprising a metallic material. Each of the plurality of cleats is overmolded onto the plate. Each of the plurality of cleats includes an internal portion and an external portion coupled to the external portion, the external portion is disposed outside the plate, the internal portion is disposed inside the plate, and the external portion includes a surface having a serrated configuration.

Clause 2: The internal portion includes a lattice framework, the lattice framework defines a plurality of holes, the plate partly extends through the holes of the lattice framework to secure the plurality of cleats to the plate, the plurality of cleats is a plurality of first cleats, the plate includes an external shell and an internal structure, the internal structure is disposed over the external shell, the plurality of cleats is a plurality of first cleats, the internal portion is a first internal portion, the external portion is a first external portion, the lattice framework is a first lattice framework, the plate defines a central portion and a peripheral portion, the peripheral portion surrounds the central portion, the plurality of first cleats is disposed along the peripheral portion of the plate, the sole structure further includes a plurality of second cleats disposed along the central portion of the plate, each of the plurality of second cleats comprises a metallic material, and a shape of each of the plurality of first cleats is different from a shape of each of the plurality of second cleats.

Clause 3: The first internal portion is embedded in the internal structure to secure the plurality of first cleats to the plate, the first lattice framework is configured as a truss, the first lattice framework includes a plurality of struts and a central lattice structure, at least two of the plurality of struts are connected to the central lattice structure to define a central hole of the plurality of holes.

Clause 4: The first internal portion includes a plurality of protruding panels extending orthogonally from the first lattice framework.

Clause 5: The plurality of holes includes two lateral holes, the central hole is disposed between the two lateral holes, and each of the central hole and the two lateral holes are configured to receive portions of the internal structure to secure the plate to the plurality of first cleats.

Clause 6: The struts have different angular orientations to allow the first lattice framework to resist forces on the plurality of the first cleats along different directions.

Clause 7: The first external portion includes a curved plate, the curved plate has a boomerang-like shape, the first external portion is integrally coupled to the first internal portion so as to form a one-piece structure, and the curved plate is configured to engage a ground.

Clause 8: The curved plate includes an outer plate surface and an inner plate surface opposite to the outer plate surface, and the curved plate includes a plurality of ribs along the outer plate surface to enhance a structural integrity of the first external portion.

Clause 9: Each of the plurality of second cleats includes a second internal portion and a second external portion coupled to the second internal portion, the second external portion is disposed outside the plate, the first internal portion is embedded in the plate to secure the plate to the plurality of second cleats, the second internal portion includes a second lattice framework, and the second lattice framework defines a plurality of openings to allow portions of the internal structure to extend through the plurality of openings, thereby securing the plurality of second cleats to the plate.

Clause 10: The second lattice framework includes a plurality of bars and an upper panel, each of the plurality of bars is coupled to the upper panel, the upper panel has a planar configuration, each of the plurality of bars is obliquely angled relative to the upper panel, and the bars are spaced apart from each other to define the plurality of openings.

Clause 11: Each of the plurality of bars is directly connected to the second external portion, the second external portion includes a pronged structure, the pronged structure includes a base and a plurality of prongs extending from the base, the prongs are spaced apart from each other at an oblique angle relative to each other, and each of the plurality of prongs is angled upwardly toward the upper panel.

Clause 12: The pronged structure includes a recessed surface opposite the base, the base has a planar configuration, the recessed surface partly defines the plurality of openings to allow portions of the internal structure to extend through each of the plurality of openings, thereby securing the second cleats to the plate.

Clause 13: The internal structure has an inner structure surface and an outer structure surface opposite the inner structure surface, the internal structure includes a plurality of supporting structures disposed in different locations of the inner structure surface, and each of the plurality of supporting structures has a lattice geometry, the lattice geometry has a crisscrossed pattern of strips and recesses.

Clause 14: The plurality of supporting structures includes a plurality of cleat supporting structures, each of the plurality of cleat supporting structures is aligned with one of the plurality of first cleats, and the plurality of cleat supporting structures have a same shape as the plurality of first cleats.

Clause 15: The plurality of supporting structures includes a plurality of stand-alone supporting structures, and the stand-alone supporting structures are not aligned with the first cleats.

Clause 16: A first one of the plurality of stand-alone supporting structures is disposed diagonally along the central portion of the plate, and a second one of the plurality of stand-alone supporting structures is disposed along the peripheral portion of the plate.

Clause 17: A method of making a sole structure, comprising: forming a plurality of cleats using metal injection molding; and overmolding a plate onto a plurality of cleats.

Clause 18: Forming the plurality of cleats includes forming a plurality of first cleats and a plurality of second cleats using the metal injection molding, and a shape of the plurality of first cleats is different from a shape of the plurality of second cleats.

Clause 19: Overmolding the plate onto the plurality of cleats includes overmolding an internal structure of the plate onto the plurality of first cleats and the plurality of second cleats to secure the plurality of first cleats and the plurality of second cleats to the internal structure Clause 20: Overmolding the plate onto the plurality of cleats further includes overmolding an external shell of the plate onto the internal structure to secure the external shell to the internal structure.

Clause 21: A sole structure comprising: a polymeric sole plate having an inner surface and an opposite ground facing surface; a plurality of metal cleats, each metal cleat comprising: an internal portion embedded within the polymeric sole plate; and an external portion coupled to the internal portion and extending outward from the ground facing surface of the polymeric sole plate, wherein the external portion of the metal cleat is operative to contact the ground during use; wherein the internal portion further includes a plurality of apertures through which the polymeric sole plate extends.

Clause 22: The sole structure of Clause 21, wherein the internal portion further includes a main body portion comprising the apertures, and at least one panel protruding transversely to the main body portion.

Clause 23: The sole structure of Clause 22, wherein the at least one panel is about parallel to the ground facing surface of the polymeric sole plate.

Clause 24: The sole structure of Clause 21, wherein the external portion of each of the plurality of metal cleats has a crescent shape comprising an inner concave side and an opposite outer convex side.

Clause 25: The sole structure of Clause 24, wherein the polymeric sole plate comprises a heel portion and a forefoot portion; wherein a first set of the plurality of metal cleats is disposed within the forefoot portion, and a second set of the plurality of metal cleats is disposed within the heel portion; and wherein the inner concave side of each of the first set of metal cleats substantially faces in a direction toward the heel portion and wherein the inner concave side of each of the second set of metal cleats substantially faces the forefoot portion.

Clause 26: The sole structure of Clause 24, wherein at least one of the convex side andside and the concave side of each metal cleat has a serrated outer profile.

Clause 27: The sole structure of Clause 21, wherein each of the plurality of metal cleats is formed through a metal injection molding process.

Clause 28: The sole structure of Clause 21, wherein the sole plate includes a plurality of protruding cleat bases that each extend in a direction away from the inner surface of the sole plate; and wherein the external portion of each of the metal cleats extends from a respective one of the protruding cleat bases.

Clause 29: The sole structure of Clause 28, wherein the ground facing surface of the cleat base smoothly and continuously transitions into an outer surface of the external portion of each respective metal cleat.

Clause 30: The sole structure of Clause 21, wherein the internal portion comprises a lattice structure.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear, comprising:

a plate comprising a polymeric material;

a plurality of cleats each comprising a metallic material, wherein each of the plurality of cleats is overmolded onto the plate;

wherein each of the plurality of cleats includes an internal portion and an external portion coupled to the external portion, the external portion is disposed outside the plate, the internal portion is disposed inside the plate; and wherein the external portion includes a surface having a serrated configuration; and wherein the internal portion includes a lattice framework, the lattice framework defines a plurality of holes, the plate partly extends through the holes of the lattice framework to secure the plurality of cleats to the plate, the plurality of cleats is a plurality of first cleats, the plate includes an external shell and an internal structure, the internal structure is disposed over the external shell, the plurality of cleats is a plurality of first cleats, the internal portion is a first internal portion, the external portion is a first external portion, the lattice framework is a first lattice framework, the plate defines a central portion and a peripheral portion, the peripheral portion surrounds the central portion, the plurality of first cleats is disposed along the peripheral portion of the plate, the sole structure further includes a plurality of second cleats disposed along the central portion of the plate, each of the plurality of second cleats comprises a metallic material, and a shape of each of the plurality of first cleats is different from a shape of each of the plurality of second cleats.

2. The sole structure of claim 1, wherein the first internal portion is embedded in the internal structure to secure the plurality of first cleats to the plate, the first lattice framework is configured as a truss, the first lattice framework includes a plurality of struts and a central lattice structure, at least two of the plurality of struts are connected to the central lattice structure to define a central hole of the plurality of holes.

3. The sole structure of claim 2, wherein the first internal portion includes a plurality of protruding panels extending orthogonally from the first lattice framework.

4. The sole structure of claim 2, wherein the struts have different angular orientations to allow the first lattice framework to resist forces on the plurality of the first cleats along different directions.

5. The sole structure of claim 2, wherein the first external portion includes a curved plate, the curved plate has a boomerang-like shape, the first external portion is integrally coupled to the first internal portion so as to form a one-piece structure, and the curved plate is configured to engage a ground.

6. The sole structure of claim 5, wherein the curved plate includes an outer plate surface and an inner plate surface opposite to the outer plate surface, and the curved plate includes a plurality of ribs along the outer plate surface to enhance a structural integrity of the first external portion.

7. The sole structure of claim 2, wherein each of the plurality of second cleats includes a second internal portion and a second external portion coupled to the second internal portion, the second external portion is disposed outside the plate, the first internal portion is embedded in the plate to secure the plate to the plurality of second cleats, the second internal portion includes a second lattice framework, and the second lattice framework defines a plurality of openings to allow portions of the internal structure to extend through the plurality of openings, thereby securing the plurality of second cleats to the plate.

8. The sole structure of claim 7, wherein the second lattice framework includes a plurality of bars and an upper panel, each of the plurality of bars is coupled to the upper panel, the upper panel has a planar configuration, each of the plurality of bars is obliquely angled relative to the upper panel, and the bars are spaced apart from each other to define the plurality of openings.

9. The sole structure of claim 8, wherein each of the plurality of bars is directly connected to the second external portion, the second external portion includes a pronged structure, the pronged structure includes a base and a plurality of prongs extending from the base, the prongs are spaced apart from each other at an oblique angle relative to each other, and each of the plurality of prongs is angled upwardly toward the upper panel.

10. The sole structure of claim 9, wherein the pronged structure includes a recessed surface opposite the base, the base has a planar configuration, the recessed surface partly defines the plurality of openings to allow portions of the internal structure to extend through each of the plurality of openings, thereby securing the second cleats to the plate.

11. A sole structure comprising:

a polymeric sole plate having an inner surface and an opposite ground facing surface;

a plurality of metal cleats, each metal cleat comprising:

an internal portion embedded within the polymeric sole plate; and an external portion coupled to the internal portion and extending outward from the ground facing surface of the polymeric sole plate, wherein the external portion of the metal cleat is operative to contact the ground during use; and wherein the internal portion further includes a plurality of apertures through which the polymeric sole plate extends; and wherein the internal portion includes a lattice framework, the lattice framework defines the plurality of apertures, the plate partly extends through the apertures of the lattice framework to secure the plurality of metal cleats to the polymeric sole plate, the plurality of metal cleats is a plurality of first cleats, the polymeric sole plate includes an external shell and an internal structure, the internal structure is disposed over the external shell, the plurality of cleats is a plurality of first cleats, the internal portion is a first internal portion, the external portion is a first external portion, the lattice framework is a first lattice framework, the polymeric sole plate defines a central portion and a peripheral portion, the peripheral portion surrounds the central portion, the plurality of first cleats is disposed along the peripheral portion of the plate, the sole structure further includes a plurality of second cleats disposed along the central portion of the plate, each of the plurality of second cleats comprises a metallic material, and a shape of each of the plurality of first cleats is different from a shape of each of the plurality of second cleats.

12. The sole structure of claim 11, wherein the internal portion further includes a main body portion comprising the apertures, and at least one panel protruding transversely to the main body portion.

13. The sole structure of claim 12, wherein the at least one panel is about parallel to the ground facing surface of the polymeric sole plate.

14. The sole structure of claim 13, wherein the external portion of each of the plurality of metal cleats has a crescent shape comprising an inner concave side and an opposite outer convex side.

15. The sole structure of claim 14, wherein the polymeric sole plate comprises a heel portion and a forefoot portion; and wherein a first set of the plurality of metal cleats is disposed within the forefoot portion, and a second set of the plurality of metal cleats is disposed within the heel portion; and wherein the inner concave side of each of the first set of metal cleats substantially faces in a direction toward the heel portion and wherein the inner concave side of each of the second set of metal cleats substantially faces the forefoot portion.

16. The sole structure of claim 13, wherein at least one of the convex side and the concave side of each metal cleat has a serrated outer profile.

17. The sole structure of claim 11, wherein each of the plurality of metal cleats is formed through a metal injection molding process.

18. The sole structure of claim 11, wherein the sole plate includes a plurality of protruding cleat bases that each extend in a direction away from the inner surface of the sole plate; and wherein the external portion of each of the metal cleats extends from a respective one of the protruding cleat bases.

19. The sole structure of claim 18, wherein the ground facing surface of the cleat base smoothly and continuously transitions into an outer surface of the external portion of each respective metal cleat.

* * * * *